US005694664A

United States Patent [19]

Newton et al.

[11] Patent Number: 5,694,664

[45] Date of Patent: Dec. 9, 1997

[54] COUPLING FOR SPIRAL COUNTERBALANCE

[75] Inventors: William P. Newton, Spencerport; John I. Habbersett, Rochester, both of N.Y.

[73] Assignee: Caldwell Manufacturing Company, Rochester, N.Y.

[21] Appl. No.: 679,619

[22] Filed: Jul. 10, 1996

[51] Int. Cl.[6] ..... E05D 13/00; E05F 1/00

[52] U.S. Cl. ..... 16/197; 49/445

[58] Field of Search ..... 16/197, 193, DIG. 16; 49/445, 446, 447

[56] References Cited

U.S. PATENT DOCUMENTS

| | | | |
|---|---|---|---|
| 2,477,069 | 7/1949 | Larson | 16/197 |
| 2,580,705 | 1/1952 | Tappan | 16/197 |
| 2,774,100 | 12/1956 | Larson et al. | 16/197 |
| 2,890,480 | 6/1959 | Gregg et al. | 16/197 |
| 2,929,095 | 3/1960 | Nobes | 16/197 |
| 3,478,384 | 11/1969 | Skolnik | 16/197 |
| 5,152,032 | 10/1992 | Davis et al. | 16/197 |
| 5,267,416 | 12/1993 | Davis | 16/197 |
| 5,383,303 | 1/1995 | Nakamishi et al. | 49/445 |

*Primary Examiner*—Chuck Y. Mah

*Attorney, Agent, or Firm*—Eugene Stephens & Associates

[57] ABSTRACT

A coupling between a twisted rod and a torsion spring of a spiral counterbalance is found to be subject to deformation against the twisted rod from compressive force of the grip of the terminal convolutions of the torsion spring. This problem is solved by using a metal cylinder in the rotation transmission sleeve of the coupling to resist the compressive force and prevent deformation so that the twisted rod can move freely within the coupling. This solution also allows the use of a stronger torsion spring to exert a larger counterbalance force.

23 Claims, 2 Drawing Sheets

COUPLING FOR SPIRAL COUNTERBALANCE

TECHNICAL FIELD

Spiral counterbalances using twisted rods and torsion springs.

BACKGROUND

Spiral counterbalances have long been popular, especially for counterbalancing window sash. Spiral counterbalances are also a well-developed art involving twisted rods surrounded by, and coupled in various ways, to torsion springs. These are arranged within tubes so that as a twisted rod extends from the tube and retracts back into the tube, it rotates a coupling arranged at an open end of the tube so that the coupling transmits the rotation to the torsion spring for a counterbalance effect.

U.S. Pat. Nos. 5,152,032 and 5,267,416 show recent examples of spiral counterbalances having a coupling between a twisted rod and a torsion spring. The counterbalances of these patents have an extension spring that extends with a twisted rod, in addition to the torsion spring that is wound up when the rod extends. The extension spring is not involved in the coupling between the twisted rod and the torsion spring and is not necessary to this invention. The art also contains a multitude of older patents on spiral counterbalances using similar couplings between a twisted rod and a torsion spring.

We have discovered two operational problems with spiral counterbalances arranged in windows. The first problem can cause a sash to stick in place and resist movement and then suddenly break free and move for a distance to a new sticking or movement-resistant position. The second problem can cause a sash to move downwardly from a desired vertical position. These problems may be significant enough to warrant the complete replacement of the spiral counterbalances involved.

To identify the causes of these problems, we have autopsied many spiral balances. In these autopsies, we have carefully cut away portions of a spiral counterbalance so we can observe its interior while it still operates. Our investigations gradually gathered evidence of possible causes and effects, until we were able to diagnose the problems. Once we learned the cause of the stick and jump and downward movement effects in spiral counterbalances, we were able to devise a solution to the problems so that the remedy would allow a counterbalance to operate smoothly during its life.

A surprising consequence to our solution to these problems for spiral counterbalances is that the solution allows the construction of counterbalances capable of greater lifting force than their predecessors, without increasing the size of the spiral counterbalance. This means that spiral counterbalances no larger than their predecessors can counterbalance a heavier sash, which is clearly an advantage in the window industry, where sashes have tended to become heavier.

SUMMARY OF THE INVENTION

Our solution to the stick and jump and downward movement problems for spiral counterbalances first involved investigating to determine the cause of those problems. This turned out to be compressive deformation of a resin sleeve of the coupling from the grip exerted by the torsion spring. Terminal convolutions of the torsion spring are wrapped tightly around the coupling sleeve so that rotation of the coupling is transmitted to the torsion spring via the spring grip on the sleeve. The coupling includes a molded resin follower engaging opposite faces of the twisted rod, and the coupling rotates in response to axial movement of the twisted rod. Rotation of the coupling in response to rod movement winds and unwinds the torsion spring; and as the torsion spring winds up to exert counterbalance force, its terminal convolutions grip the coupling sleeve more tightly. The grip on the coupling sleeve by the tightened terminal convolutions of the torsion spring compressively deforms the coupling sleeve against the twisted rod so that the inside of the coupling sleeve is deformed into a shape partially matching the shape of the twisted rod. The resulting intimate contact between the rod and the inside of the coupling sleeve inhibits free axial movement between the two parts, causing the sash to stick or resist movement.

A second consequence of the compressive deformation of the resin sleeve of the coupling is the possibility of relative rotation of the torsion spring to the coupling sleeve. As the terminal convolutions of the torsion spring deform the coupling sleeve, the outside diameter of the coupling sleeve can be compressively decreased, thus decreasing the grip of the torsion spring on the coupling sleeve. The reduced grip can allow the terminal convolutions of the torsion spring to slip rotationally to the coupling sleeve, effectively reducing the torsional loading of the torsion spring on the rod.

Such deformation is especially likely to happen on a hot day when the sash is closed, which is a common environment for a spiral counterbalance. When warm, the molded resin of the coupling is most likely to creep; and when the sash is closed, the twisted rod is fully extended from the counterbalance tube, which causes the torsion spring to be wound to its fullest extent, giving its terminal convolutions the most compressive grip. The result deforms the softened coupling sleeve against the twisted rod.

The solution we prefer is forming the coupling of resin and metal parts arranged so that a resin portion can follow the twisted rod and accomplish the necessary rotation; and a metal portion, preferably in the form of a cylinder, can be arranged between the twisted rod and the terminal convolutions of the torsion spring to resist the compressive force that they apply in their grip on the coupling sleeve. There are several ways that such a resin and metal coupling can be formed. One way that we prefer is to mold a resin follower with an extension or sleeve into which a metal cylinder is pressed so that the terminal convolutions of the torsion spring engage a resin outer layer of the sleeve, and the metal tube or cylinder pressed into the sleeve resists the compressive force of the spring grip and surrounds the twisted rod so that the sleeve gripped by the torsion spring cannot be deformed. Another possibility is to form the coupling sleeve of a metal tube or cylinder engaged directly by the terminal convolutions of the torsion spring to resist the compressive force that they apply. Such a metal cylinder is non-rotationally joined to a molded resin follower that engages and follows opposite faces of the twisted rod as it extends and retracts.

DRAWINGS

DETAILED DESCRIPTION

Figure 1:
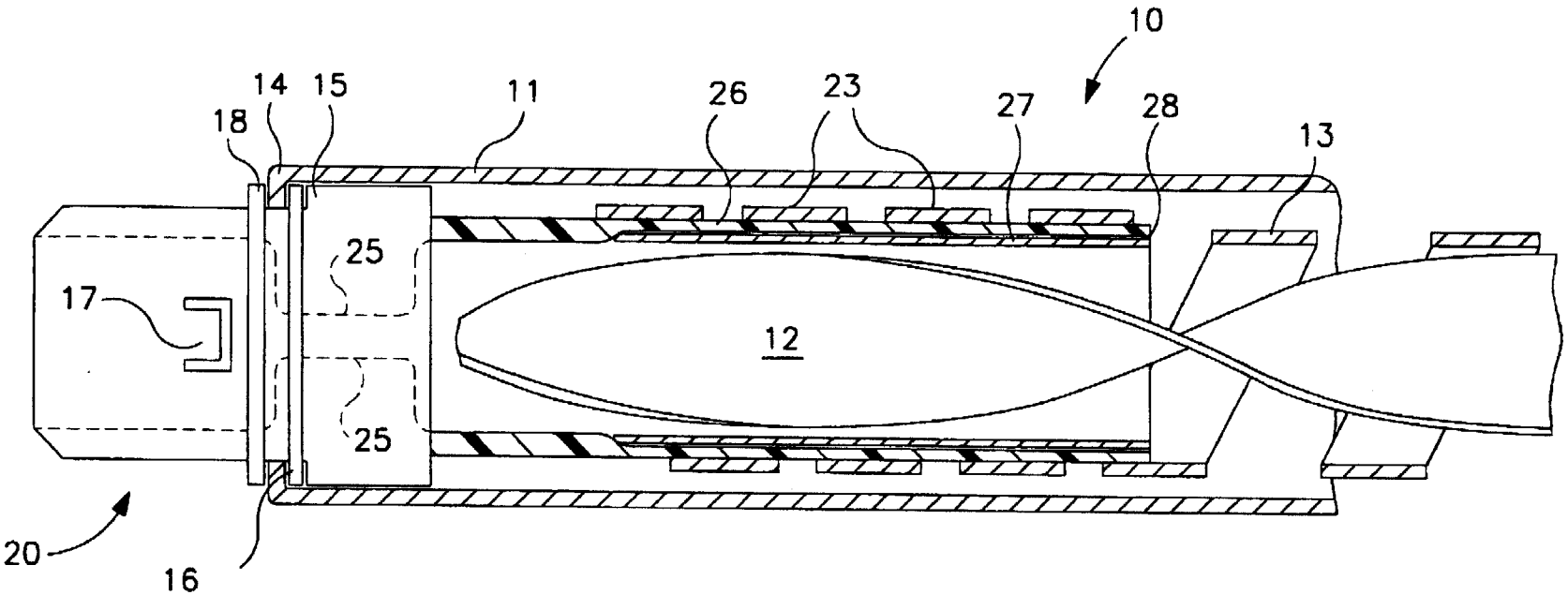
FIG. 1 is a partially schematic and partially cutaway view of a preferred embodiment of coupling between a twisted rod and a torsion spring arranged within a counterbalance tube.
Figure 2:
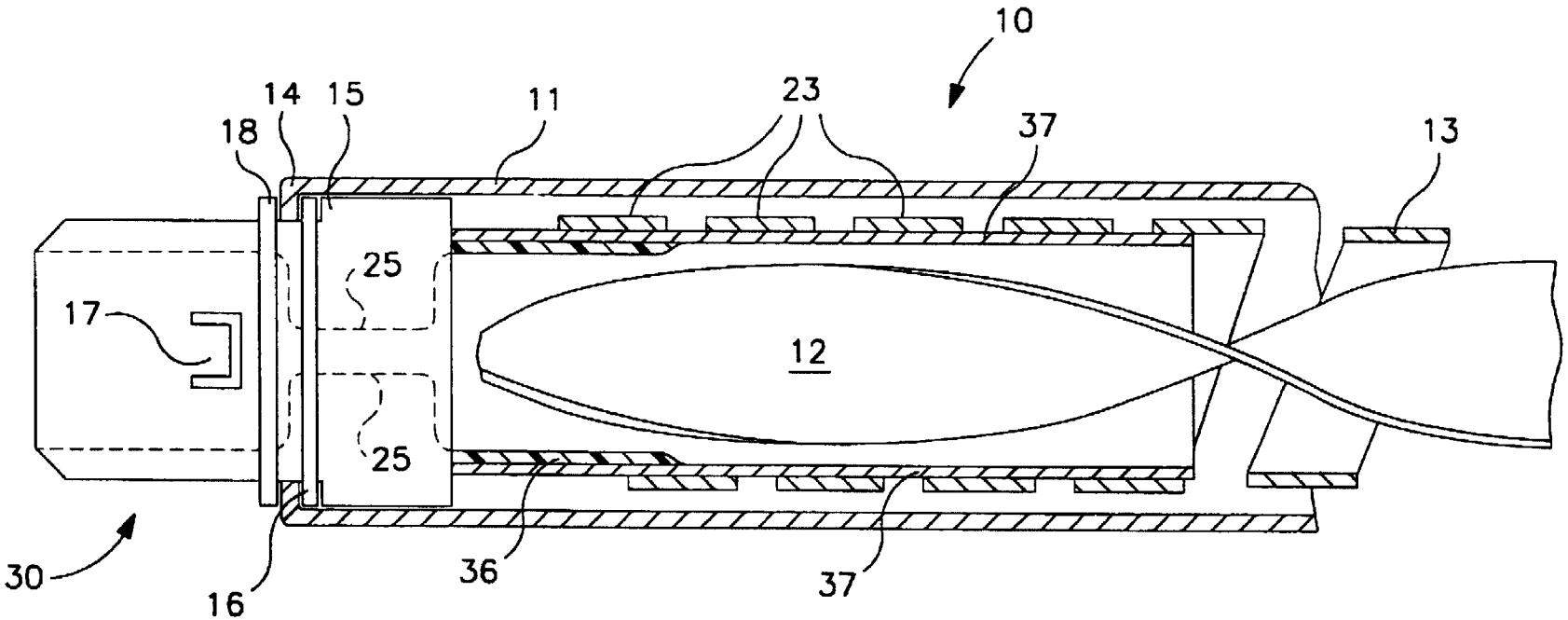
FIG. 2 is a partially cutaway and partially schematic view, similar to the view of FIG. 1, showing a preferred alternative form of coupling arranged between a twisted rod and a torsion spring within a counterbalance tube.

Couplings 20 and 30, respectively shown in the spiral counterbalances 10 of FIGS. 1 and 2, represent two preferred alternatives of the inventive solution for preventing couplings from being deformed by the grip of torsion springs. The spiral counterbalance environment shared by couplings 20 and 30 includes container tubes 11, twisted rods 12, and torsion springs 13.

Each of the couplings 20 and 30 is rotationally mounted and axially fixed in an open end of tube 11. This can be accomplished in a variety of ways and in the illustrated embodiments involves an inturned lip 14 on the open end of tube 11 engaging a lug surface 15 of couplings 20 and 30. A washer 16 is between the coupling and the inside of inturned tube lip 14, where it provides a smooth surface engaging the rotating coupling. Flexible retainers 17 formed of the molded resin portion of couplings 20 and 30 retain the couplings against moving axially into tube 11. Another washer 18 is preferably arranged between retainers 17 and the outside of lip 14. With such an arrangement, or with any of several variations of such an arrangement, couplings 20 and 30 are held against axial movement relative to tube 11, but are freely rotatable within the open end of tube 11.

Couplings 20 and 30 each include a molded resin follower element 25 that engages opposite faces of twisted rod 12 and rotates the couplings as twisted rod 12 extends from and retracts back into tube 11. Rotation of couplings 20 and 30 from the action of followers 25 engaging the twisted contour of rod 12 is transmitted to torsion spring 13 by respective sleeves or extensions of couplings 20 and 30. These differ from each other and illustrate two of the preferred alternatives of the solutions we have discovered to remedy the problem of compressive deformation of coupling sleeves.

Rotation transmission sleeve 26 of coupling 20 is made thin enough and is formed with an inside diameter large enough to receive metal tube or cylinder 27 that is press fit into the open end of coupling sleeve 26. Cylinder 27 has a flared end 28 that limits its press fit insertion into sleeve 26 and provides added strength and resistance to deformation. Cylinder 27 preferably rotates with sleeve 26 and the rest of coupling 20 as twisted rod 12 extends and retracts, and the metal of cylinder 27 has sufficient strength for effectively resisting the compressive force applied to metal sleeved extension 26 by the terminal convolutions 23 of torsion spring 13. These wrap tightly around the outside of sleeve 26 in a frictional grip that ensures transmission of rotation from coupling 20 to torsion spring 13.

The grip of terminal convolutions 23 increases when torsion spring 13 winds more tightly as twisted rod 12 extends farther from tube 11. The tightest spring winding happens when a counterbalanced window sash in a lower half of a window is in a closed position. Even though sleeve 26 is under considerable compressive force from terminal convolutions 23, and even though the resin of coupling 20 tends to creep at high temperatures, sleeve 26 is prevented from being deformed against twisted rod 12 by the compressive resistance of inner metal sleeve 27.

Since sleeve 26 is integral with follower element 25 imposing rotation on coupling 20, and since sleeve 26 is directly gripped by terminal convolutions 23 of torsion spring 13, rotation transmission from coupling 20 to spring 13 is reliable. Also, since reinforcing tube 27 presents adequate resistance to the compressive force applied by terminal convolutions 23, metal sleeved extension 26 cannot be deformed inward against edges of twisted rod 12. This leaves twisted rod 12 free to move axially relative to coupling 20 so that a sash being counterbalanced is not subject to the stick and jump problem that was analyzed in the course of reaching this invention.

A rotation transmission extension 36 of coupling 30 is joined to a metal cylinder or sleeve 37 that transmits rotation of coupling 30 to terminal convolutions 23 of torsion spring 13. These directly grip the outer surface of metal sleeve 37, which is strong enough to resist the compressive force applied by terminal convolutions 23. Metal cylinder 37 is non-rotationally joined to follower extension sleeve 36 so that metal-sleeve 37 rotates with coupling 30. A configurational departure from cylindrical, or some other expedient, can be used to ensure that no rotational slippage occurs between metal cylinder 37 and coupling sleeve 36. A press fit between resin sleeve 36 and metal sleeve 37 is also desirable for its simplicity and low cost.

Many other possibilities can be adopted for combining metal sleeves with resin sleeves of couplings for spiral counterbalances. The preferred characteristics of such alternatives are economy of manufacture and reliable operation. The principle followed in any such alternatives is using a metal cylinder to avoid the inventively discovered problem of deformation of a resin sleeve against a twisted rod by the compressive force of the grip of a torsion spring. Incorporating a metal cylinder into a coupling extension sleeve follows readily from the inventive insight into the previously unknown causes of the sticking, jumping, and downward movement of sashes counterbalanced by spiral counterbalances.

Adoption of metal sleeves increasing the compressive resistance of rotation transmission extensions of couplings has led to the discovery that stronger torsion springs can be employed without increasing the size of the spiral counterbalance. This allows counterbalances of the same sizes as previously used to provide an increased lifting force that can counterbalance a heavier sash. In effect, compressive resistance of couplings having only resin material in their rotation transmission sleeves has been a limiting factor on the counterbalance force that could be applied by a torsion spring. Once the compressive force resistance of the coupling sleeve is increased by using a metal cylinder according to the invention, the strength of the torsion spring can also be increased, to give a spiral counterbalance increased lifting force.

We claim:

1. A coupling between a twisted rod and a torsion spring arranged within a tube of a spiral counterbalance, the coupling comprising:

a. a rotation transmission extension gripped by terminal convolutions of the torsion spring, the extension comprising a metal sleeve resisting inward compressive force from the surrounding grip of the terminal convolutions of the torsion spring;

b. the rotation transmission extension surrounding the twisted rod and allowing the twisted rod freedom to extend and retract from the counterbalance tube;

c. a molded resin follower engaging opposite faces of the twisted rod so that the follower rotates when the twisted rod extends and retracts from the counterbalance tube; and d. the rotation transmission extension being rotated by the follower as the rod extends and retracts from the counterbalance tube so that the extension turns the torsion spring.

2. The coupling of claim 1 wherein the rotation transmission extension includes a molded resin element that is integral with the follower.

3. The coupling of claim 2 wherein the metal sleeve is press fit into an inside of the molded resin element.

4. The coupling of claim 2 wherein the rotation transmission extension has a resin outer surface engaged by the terminal convolutions of the torsion spring.

5. The coupling of claim 1 wherein the molded resin follower is press fit into the metal sleeve.

6. The coupling of claim 5 wherein the terminal convolutions of the torsion spring engage the metal sleeve.

7. A rotation transmitting coupling arranged between an axially movable twisted rod and a torsion spring arranged around the rod within a tube in a spiral counterbalance, the coupling comprising:

a. a metal sleeve arranged between the twisted rod and terminal gripping convolutions of the torsion spring where the metal sleeve is positioned to resist compressive force from the grip of the terminal convolutions;

b. the twisted rod being free to move within the metal sleeve as the rod extends and retracts from the counterbalance tube;

c. the metal sleeve being non-rotationally joined to a molded resin follower that engages opposite faces of the twisted rod for rotating the follower and the metal sleeve as the rod extends and retracts from the tube; and d. rotation of the follower and the metal sleeve being transmitted to the torsion spring by the grip of the terminal convolutions of the torsion spring applied in a region around the metal sleeve.

8. The coupling of claim 7 wherein the metal sleeve is press fit into an extension of the molded resin follower.

9. The coupling of claim 8 wherein the terminal convolutions of the torsion spring engage the resin extension in a region surrounding the metal sleeve.

10. The coupling of claim 7 wherein the molded resin follower engages an inside of the metal sleeve.

11. The coupling of claim 7 wherein the terminal convolutions of the torsion spring engage the metal sleeve.

12. A coupling rotationally housed and axially fixed in an open end of a tube for a spiral counterbalance to connect between an axially movable twisted rod and a torsion spring arranged around the rod within the tube, the coupling comprising:

a. a sleeve of the coupling comprising a metal cylinder;

b. the sleeve being positioned within the counterbalance tube between the twisted rod and the torsion spring where the sleeve is gripped by terminal convolutions of the torsion spring so that compressive force from the grip of the terminal convolutions on the sleeve is resisted by the metal cylinder;

c. a molded resin follower of the coupling engaging opposite faces of the twisted rod proximate to the open end of the tube so that the follower rotates as the rod extends and retracts from the open end of the tube;

d. the molded resin follower being non-rotationally joined to the metal cylinder so that the sleeve rotates relative to the tube as the rod extends and retracts from the tube; and e. rotation of the follower and sleeve being transmitted to the torsion spring by the compressive grip of the terminal convolutions of the torsion spring so that rotation of the follower and sleeve winds and unwinds the torsion spring.

13. The coupling of claim 12 wherein the sleeve includes a molded resin extension of the follower surrounding and joining to the metal cylinder to form part of the sleeve.

14. The coupling of claim 13 wherein the metal cylinder is pressed within the molded resin extension.

15. The coupling of claim 14 wherein the terminal convolutions of the torsion spring engage the molded resin extension in a region around the metal cylinder.

16. The coupling of claim 12 wherein the follower is press fit into the metal cylinder.

17. The coupling of claim 12 wherein the terminal convolutions of the torsion spring engage the metal cylinder directly.

18. In a coupling interconnecting a torsion spring arranged around a twisted rod within a tube of a spiral counterbalance so that the coupling is axially fixed and rotationally housed in an open end of the tube from which the twisted rod extends and retracts, the improvement comprising:

a. a sleeve of the coupling gripped by terminal convolutions of the torsion spring and extending around the twisted rod comprising a metal cylinder disposed for resisting compression force from the grip of the terminal convolutions of the torsion spring; and b. a follower of the coupling formed of molded resin to engage opposite faces of the twisted rod, the follower being arranged for rotating the sleeve of the coupling as the twisted rod extends and retracts from the tube, the rotation of the follower and the sleeve being transmitted to the torsion spring by the grip of the terminal convolutions in a region around the metal cylinder.

19. The improvement of claim 18 wherein the sleeve includes a molded resin layer surrounding the metal cylinder and gripped by the terminal convolutions.

20. The improvement of claim 20 wherein the molded resin layer is formed integrally with the follower, and the metal cylinder is pressed into position within the molded resin layer.

21. The improvement of claim 18 wherein the follower is non-rotationally connected with the metal cylinder.

22. The improvement of claim 21 wherein the follower is press fit into the metal cylinder.

23. The improvement of claim 18 wherein the terminal convolutions of the torsion spring engage the metal cylinder.

* * * * *